US005707166A

United States Patent [19]

Jeannet et al.

[11] Patent Number: 5,707,166

[45] Date of Patent: Jan. 13, 1998

[54] TOOTHBRUSH

[75] Inventors: Roland Jeannet, Düsseldorf, Germany; Robert Leutwyler, Boppelsen; Werner Leutwyler, Zürich, both of Switzerland

[73] Assignee: Johnson & Johnson Consumer Products, Inc., New Brunswick, N.J.

[21] Appl. No.: 788,583

[22] Filed: Jan. 24, 1997

Related U.S. Application Data

[63] Continuation of Ser. No. 622,908, Mar. 29, 1996, abandoned, which is a continuation of Ser. No. 164,236, Dec. 9, 1993, abandoned.

[30] Foreign Application Priority Data

Dec. 15, 1992 [DE] Germany ..... 42 42 355.4

[51] Int. Cl.[6] ..... A46B 5/00

[52] U.S. Cl. ..... 403/24; 403/146; 403/157; 403/330; 15/143.1; 15/167.1

[58] Field of Search ..... 403/330, 326, 403/24, 41, 112, 113, 117, 148, 146, 157, 220, 354, 375, 78, 79, 150, 154; 15/167.1, 167.2, 143.1, 144.1

[56] References Cited

U.S. PATENT DOCUMENTS

| | | | |
|---|---|---|---|
| 759,490 | 5/1904 | Yates | 15/143.1 |
| 1,887,913 | 11/1932 | Bell | 15/167.1 X |
| 2,130,661 | 9/1938 | Zaebst | 15/167.1 |
| 2,832,943 | 4/1958 | Cutler | 403/326 X |
| 4,476,604 | 10/1984 | White et al. | 15/167.1 X |
| 4,798,492 | 1/1989 | Smith | 403/220 X |
| 4,829,621 | 5/1989 | Phenegar | 15/144.1 X |
| 5,052,071 | 10/1991 | Halm | 15/143.1 X |
| 5,054,154 | 10/1991 | Schiffer et al. | 15/143.1 X |
| 5,105,499 | 4/1992 | Dirksing | 15/143.1 |
| 5,282,291 | 2/1994 | Spieler et al. | 15/167.1 |

FOREIGN PATENT DOCUMENTS

| | | | |
|---|---|---|---|
| 174740 | 3/1986 | European Pat. Off. | 15/167.1 |
| 2550068 | 2/1985 | France | 15/167.1 |

*Primary Examiner*—Harry C. Kim

[57] ABSTRACT

The invention relates to a toothbrush (10), the brushneck (12) of which, connected to an exchangeable brushhead, is deflectably held, in a reversible, resilient manner, on a hollow handle (14) by a swivel joint (18) surrounded by a sealing element (16). The brushneck (12) is provided at its coupling end (20) facing the handle (14) with an articulated head (22). The handle exhibits at its coupling end (24) facing the brushneck (12) an articulated fork (26), between whose fork legs (28, 30) an articulated head (22) of the brushneck (12) is fitted-in and connected by a swivel axle (32). The sealing element (16) consists of a pressure-elastic material. The articulated fork (26) is itself of tension-elastic configuration, so that the sealing element (16) is held by the articulated fork (26) under elastic pre-tension between the mutually opposite coupling ends (20, 24) of the handle (14) and of the brushneck (12). The toothbrush can be economically manufactured using a least possible number of single parts and enables a deflection movement, which is elastically damped by the sealing element and by the elastically configured articulated fork, which deflection movement is limited by the articulated head.

22 Claims, 7 Drawing Sheets

TOOTHBRUSH

This is a continuation, of application Ser. No. 08/622,908, filed Mar. 29, 1996, now abandoned, which is a continuation of application Ser. No. 08/164,236, field Dec. 9, 1993, now abandoned, which are hereby incorporated by reference.

FIELD OF THE INVENTION

The invention relates to a toothbrush, the brushneck of which, connected to an exchangeable brush-head, is deflectably held, in a reversible, resilient manner, on a hollow handle by a swivel joint surrounded by a sealing element and by a tension spring extending in the handle, the brushneck being provided at its coupling end facing the handle with an articulated head and the handle exhibiting at its coupling end facing the brushneck an articulated fork, between whose fork legs the articulated head of the brushneck is fitted-in and connected by a swivel axle.

BACKGROUND OF THE INVENTION

A toothbrush is known from DE 39 21 371 C1. In the case of this toothbrush, the handle comprises two tubular parts which embrace the tension spring and can be altered for length in order that the force of the tension spring can be adjusted. The swivel axle comprises a bolt which extends through a long hole in the articulated head and through two bores in the fork. Beneath the long hole, there is disposed in the articulated head a further bolt, by means of which there is hung a hook to which the tension spring is connected by one end, the other end of the tension spring being hooked onto the end of the handle.

SUMMARY OF THE INVENTION

The object of the invention is to improve the toothbrush of the abovementioned known generic type such that, within a mass-production framework, it can be economically manufactured from a least possible number of single parts and, whilst meeting modern hygiene requirements, at the same time reliably fulfils the object of being able, when a certain contact pressure is exerted by the brushneck against the teeth to be cleaned, to execute a deflection movement elastically up to a certain intended limit.

The invention achieves this object by the fact that the annular sealing element consists of a pressure-elastic material and the articulated fork itself forms the tension spring, such that the sealing element is held by the articulated fork under elastic pre-tension between the mutually opposite coupling ends of the handle and of the brushneck.

Expediently, the dividing plane between the coupling ends of the brushneck and of the handle extends from the front wall of the toothbrush exhibiting the bristle zone obliquely forwards to the back of the toothbrush at an acute angle to the latter's longitudinal axis. As a result, a more favourable cushioning of the deflection movement of the brushneck is achieved when a certain contact pressure is exerted by the said brushneck.

Further developments of the invention are given in the subclaims.

BRIEF DESCRIPTION OF THE DRAWINGS

The invention is explained in greater detail below with reference to the diagrammatic drawing of a plurality of illustrative embodiments, in which.

DESCRIPTION OF THE PREFERRED EMBODIMENTS

Figure 1:
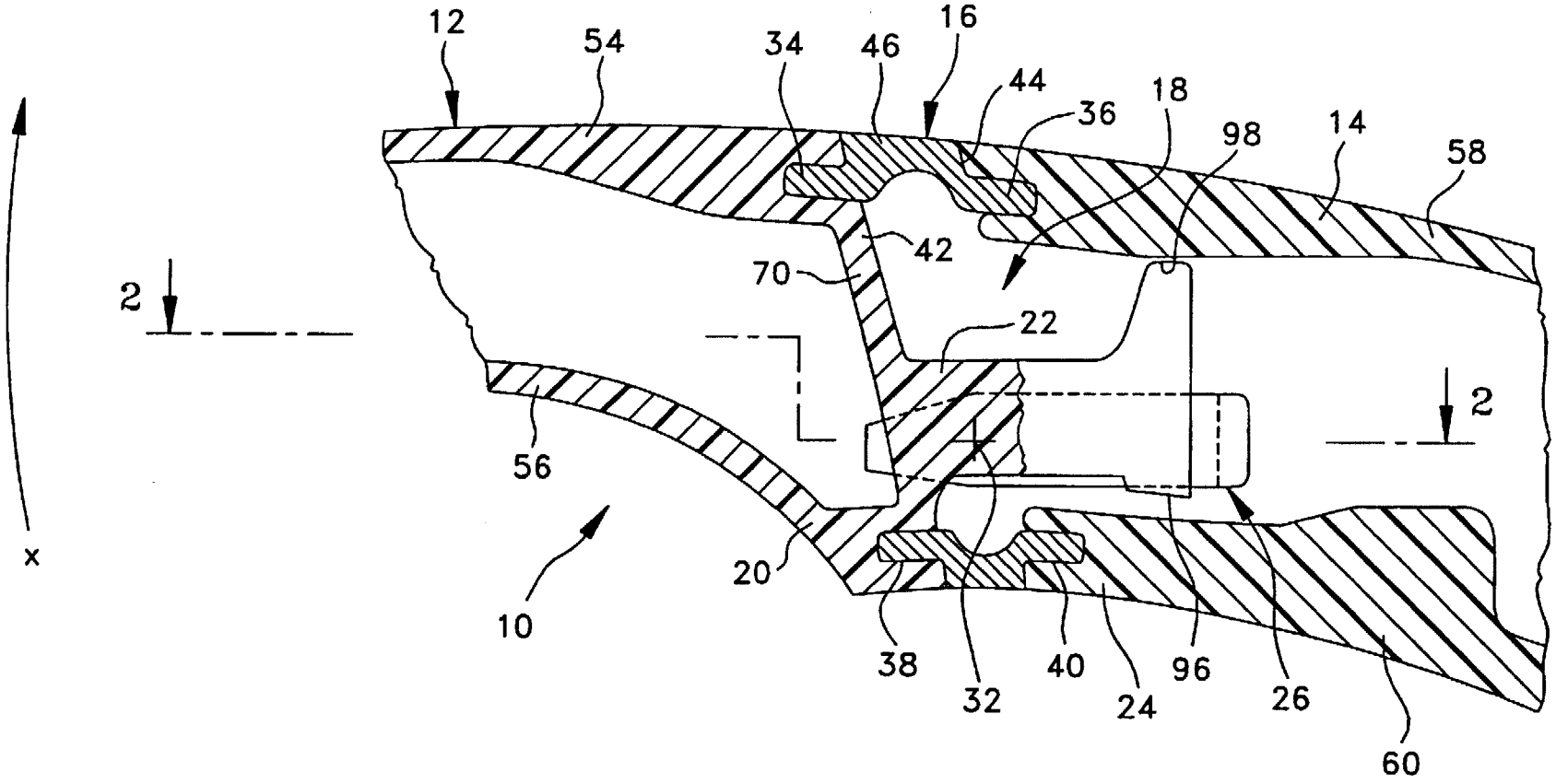
FIG. 1 shows a first embodiment of a toothbrush according to the invention in a perpendicular central longitudinal section according to the line I—I in FIG. 2 in partially fragmented representation.
Figure 2:
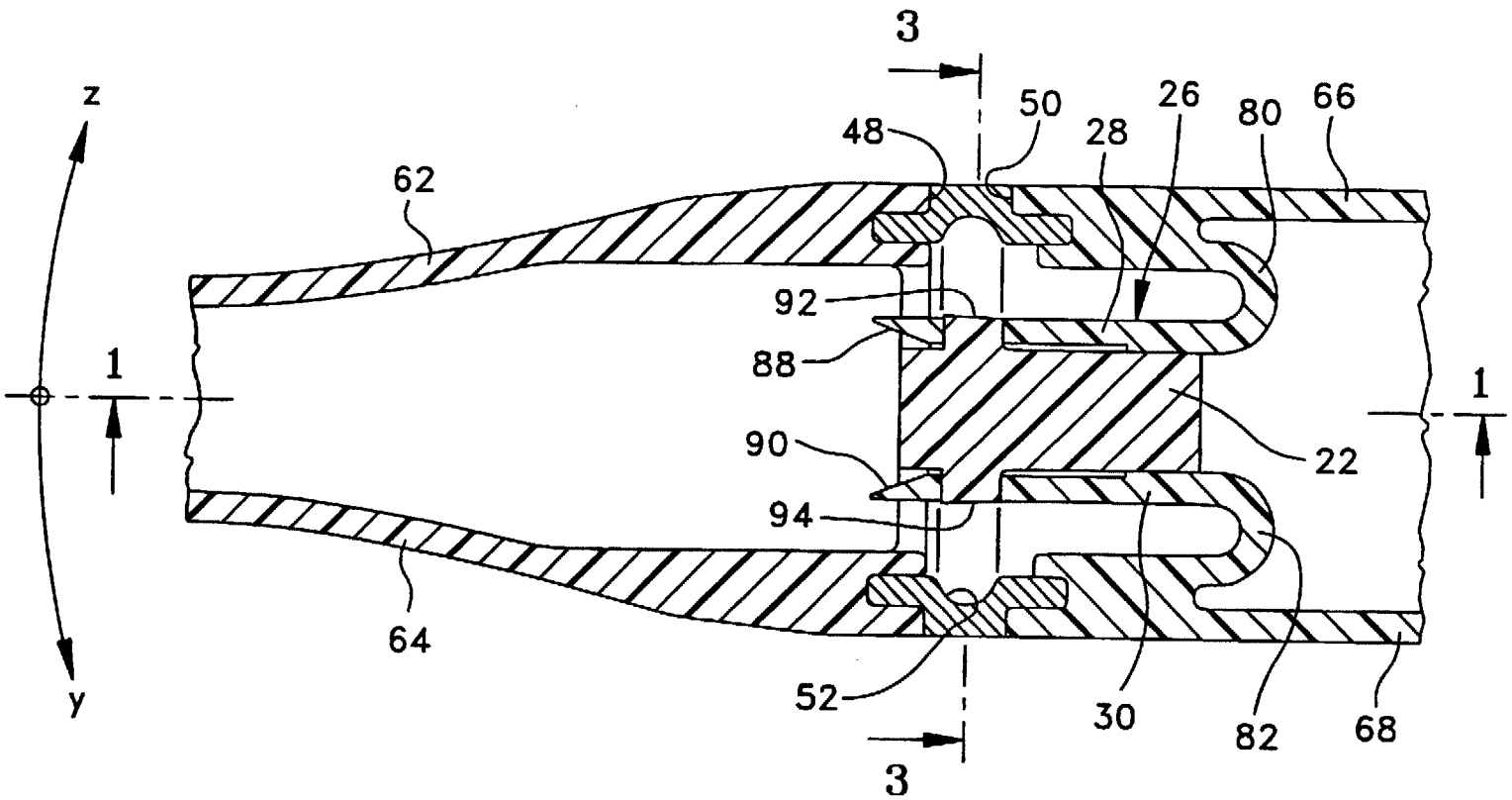
FIG. 2 shows a horizontal section according to the line II—II in FIG. 1.
Figure 3:
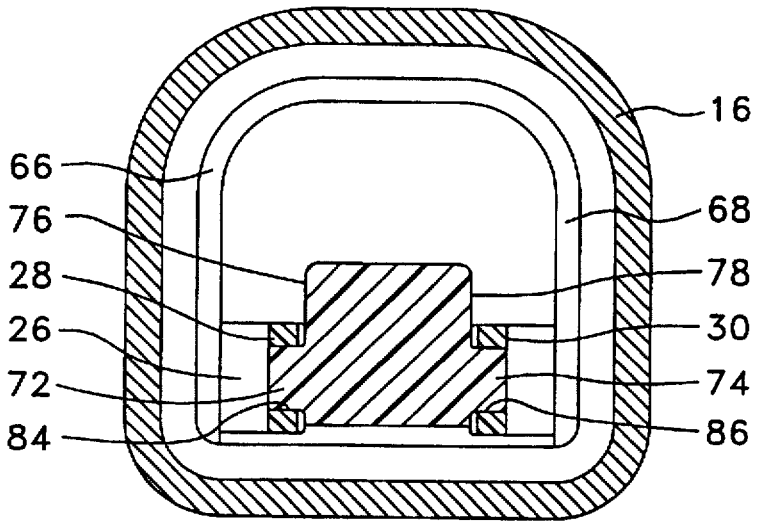
FIG. 3 shows a cross-section according to the line III—III in FIG. 2.

In FIGS. 1 to 3, there is represented a first embodiment of a toothbrush 10, the brushneck 12 of which is deflectably held, in a reversible, resilient manner, on a hollow handle 14 by a swivel joint 18 surrounded by a sealing element 16. The brushneck 12 is provided at its coupling end 20 facing the handle 14 with an articulated head 22. The handle 14 exhibits at its coupling end 24 facing the brushneck 12 an articulated fork 26 having fork legs 28, 30. The articulated head 22 is fitted-in between the fork legs 28, 30 and connected to these by a swivel axle 32.

The sealing element 16 is of annular configuration and consists of a pressure-elastic, rubber-like material. The articulated fork 26 is configured as a tension spring, such that the sealing element 16 is held by the articulated fork 26 under elastic pre-tension between the mutually opposite coupling ends 20, 24 of the brushneck 12 and of the handle 14.

The annular sealing element 16 is provided at both ends with sealing sleeves 34, 36, which engage hermetically into recesses 38, 40 which are configured as annular grooves and which are disposed in end faces 42, 44 of the coupling ends 20, 24 of the brushneck 12 and of the handle 14. The sealing element 16 is provided in the centre of its width between the sealing sleeves 34, 36 with an annular sealing bead 46, the cross-sectional profile of which coincides with the cross-sectional profile of the coupling ends 20, 24 of the brushneck 12 and of the handle 14 and bears with its two end faces 48, 50 tightly against the end faces 42, 44 of the brushneck 12 and of the handle 14.

The inner peripheral surface of the sealing bead 46 is provided with a circumferential, trough-shaped indentation 52 (FIG. 2). It can further be seen from FIG. 1 that the dividing plane between the coupling ends 20, 24 of the brushneck 12 and of the handle 14, in which plane the sealing element 16 is disposed, extends from a lower wall or front wall 56, 60 (represented in FIG. 1) of the toothbrush 10 obliquely upwards and forwards in the direction of the brushneck 12 to an upper wall or rear wall 54, 58 (shown in FIG. 1) of the said toothbrush and thus forms an acute angle with the central longitudinal axis of the toothbrush 10. Consequently, the principal plane of the sealing element 16 also runs in this plane, so that the sealing element 16 is disposed, in the area of the rear wall 54, 58 of the toothbrush 10, closer to the front end of the brushneck 12 than the lower half facing the front wall of the toothbrush 10. In other words, the rear wall 54 of the brushneck 12 is shorter in size than its front wall 56, whilst the rear wall 58 of the handle 14 is longer in size than its front wall 60. The partially fragmented side walls of the brushneck 12 are denoted in FIG. 2 by 62, 64. A brushhead, connected to the brushneck 12 and having brush base and brush zone, is known per se and is not therefore represented. The side walls of the handle 14 are denoted by 66, 68 (FIG. 2), it being apparent that both the brushneck 12 and the handle 14 comprise hollow profiles which are injection-moulded from plastic.

It can be seen from FIG. 1 that an axle 32 of the swivel joint 18 is disposed in the principal plane of the sealing element 16 close to the front side of the toothbrush 10 or of that part of the sealing element 16 which seals off the face ends of the front walls 56 or 60 of the brushneck 12 and of the handle 14. In the event of a deflection movement of the brushhead directed in the direction of the arrow x and a certain contact pressure during teeth cleaning, the above-described positions of the swivel axle 32 and of the sealing element 16 therefore enable, due to a relatively long lever arm between the swivel axle 32 and the rear wall 54, 58 of the toothbrush 10, a relatively gentle and long deflection movement of the brushneck 12.

The articulated head 22 is formed integrally with an end wall 70 of the coupling end 20 of the brushneck 12 and protrudes axially into the cavity of the handle 14. As shown in FIGS. 2 and 3, the swivel axle 32 comprises two swivel journals 72, 74, which extend coaxially from the two longitudinal sides 76, 78 of the articulated head 22.

The fork legs 28, 30 of the articulated fork 26 are respectively an integral component part of the mutually opposite side walls 66, 68 of the handle 14 and, in the area of their leg bases 80, 82, are guided out of the coupling end 24 of the handle 14 in a U-shaped formation inwardly towards each other and at a distance approximately parallel to each other. The leg ends of the articulated fork 26 are provided with coaxial, continuous openings 84, 86 (FIG. 3), into which the swivel journals 72, 74 of the articulated head 22 engage. It can be seen that the length of the swivel journals 72, 74 corresponds approximately to the wall thickness of the fork legs 28, 30. The fork legs 28, 30, in the non-fitted state of the toothbrush 10, are pre-tensioned against each other, so that they form an acute angle which opens out in the direction of the rear end (not shown) of the handle. Consequently, the fork legs 28, 30, in the locked-in state of the toothbrush 10 shown in FIG. 2, bear with pre-tension against the longitudinal sides 76, 78 of the articulated head 22.

As shown in FIGS. 2 and 3, the leg ends projecting beyond the swivel journals 72, 74 are configured on their mutually opposite inner sides as bevelled abutting surfaces 88, 90, which form with the perpendicular central longitudinal plane of the toothbrush 10 an acute angle which opens out in the direction of the brushneck 12. In addition, face ends 92, 94 of the swivel journals 72, 74 are also configured as abutting surfaces, which likewise form an acute angle with the perpendicular central longitudinal plane of the toothbrush, which angle opens out in the direction of the brushneck 12 and corresponds approximately to the angle formed by the abutting surfaces 88, 90 of the leg ends. Since the distance between the outer ends of the abutting surfaces 88, 90 of the fork legs 28, 30 is greater than the width of the articulated head 22 and the distance between the respective peripheral edges, facing away from the brushneck 12, of the face ends 92, 94 of the swivel journals 72, 74, it is ensured, upon the fitting of the toothbrush 10, by the coaxial bringing together of the coupling ends 20, 24 of the brushneck 12 and of the handle 14, that the articulated fork 26 is spread and the abutting surfaces 88, 90 of the fork legs 28, 30 are able to slide over the articulated head 22 and its swivel journals 72, 74 until the swivel journals 72, 74 lock into the openings 84, 86 in the articulated fork 26 and the fork legs 28, 30 bear with pre-tension against the longitudinal sides 76, 78 of the articulated head 22. For this purpose, the fork legs 28, 30 of the articulated fork 26 are disposed at a distance from the inner side of the adjacent side walls 66, 68 of the handle which corresponds at least to the thickness of a fork leg.

The elastic, integral configuration of the articulated fork 26 with the handle 14 also allows a deflection movement in the direction of the arrows y and z in FIG. 2, which is perpendicular to the contact-pressure direction x in FIG. 1, in which direction the brushneck 12 is normally deflected when the teeth are being cleaned. The deflection movement in the direction of the arrows y and z in FIG. 2 is only possible to a lesser extent in relation to the deflection movement in the direction of the arrow x, but is also desirable, because unintentional jolts of the brushhead, caused by incorrect manipulation, against the denture or gum tissue are thereby damped and cleaning of the teeth is therefore made more comfortable.

It is desirable to indicate perceptibly to the user the permitted limit for the contact pressure of the toothbrush 10 when cleaning the teeth. For this purpose, that end of the articulated head 22 which projects into the cavity of the handle 14 is provided with two stop cams 96, 98, which are disposed respectively at a distance from the inner side of the front wall 60 or of the rear wall 58 of the handle 14 for limiting the deflection movement in and counter to the direction of the arrow x of the brushneck 12. Naturally, in the normal position of the brushneck 12, shown in FIG. 1, in relation to the handle 14, the distance of the stop cam 96 from the inner side of the front wall 60 is substantially greater in size than the distance which the opposite stop cam 98 adopts from the inner side of the rear wall 58, because the deflection movement counter to the direction of the arrow x, occurs, if at all, only in extremely rare cases and is basically undesirable.

The above description of the first embodiment of the toothbrush 10 according to the invention in FIGS. 1 to 3 makes it clear that the toothbrush 10, disregarding the brushhead 10 (not shown), consists only of three parts, namely the brushneck 12, the handle 14 and the sealing element 16. The deflection movement in the direction of the arrow x when cleaning the teeth is cushioned by the pressure-elastic property of the sealing element 16 and the tension-spring property of the articulated fork 26, the deflection movement of the brushneck 12 being limited by the butting of the stop cam 96 against the inner side of the front wall 60. The elastic design of the articulated fork 26 and of the sealing element 16 additionally enable a damping of universal swivel and torsion movements of the brushneck 12, so that an overall high level of comfort is achieved with the toothbrush.

Figure 4:
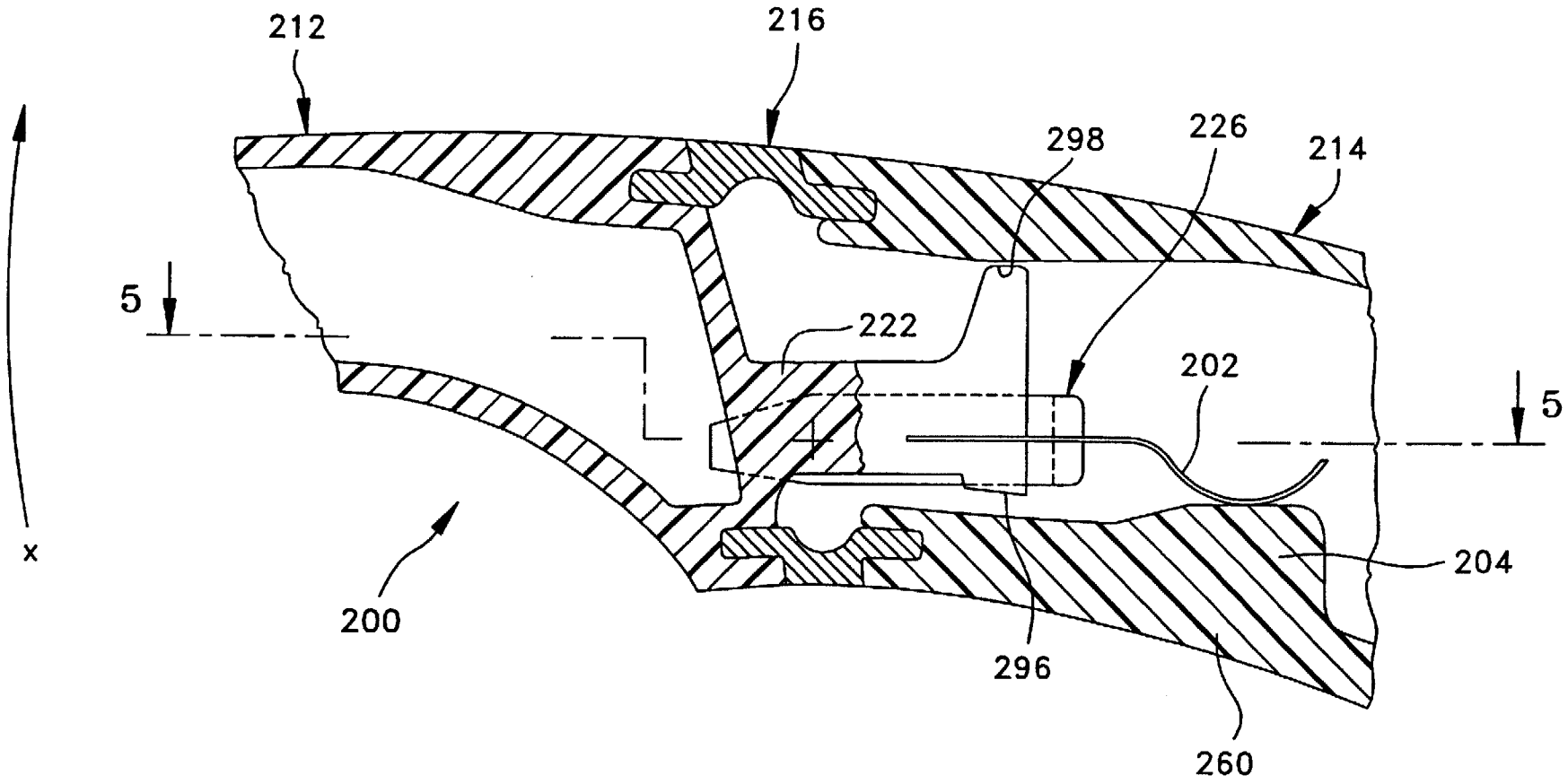
FIG. 4 shows a second embodiment of a toothbrush according to the invention in a perpendicular central longitudinal section according to the line IV—IV in FIG. 5 in partially fragmented representation.
Figure 5:
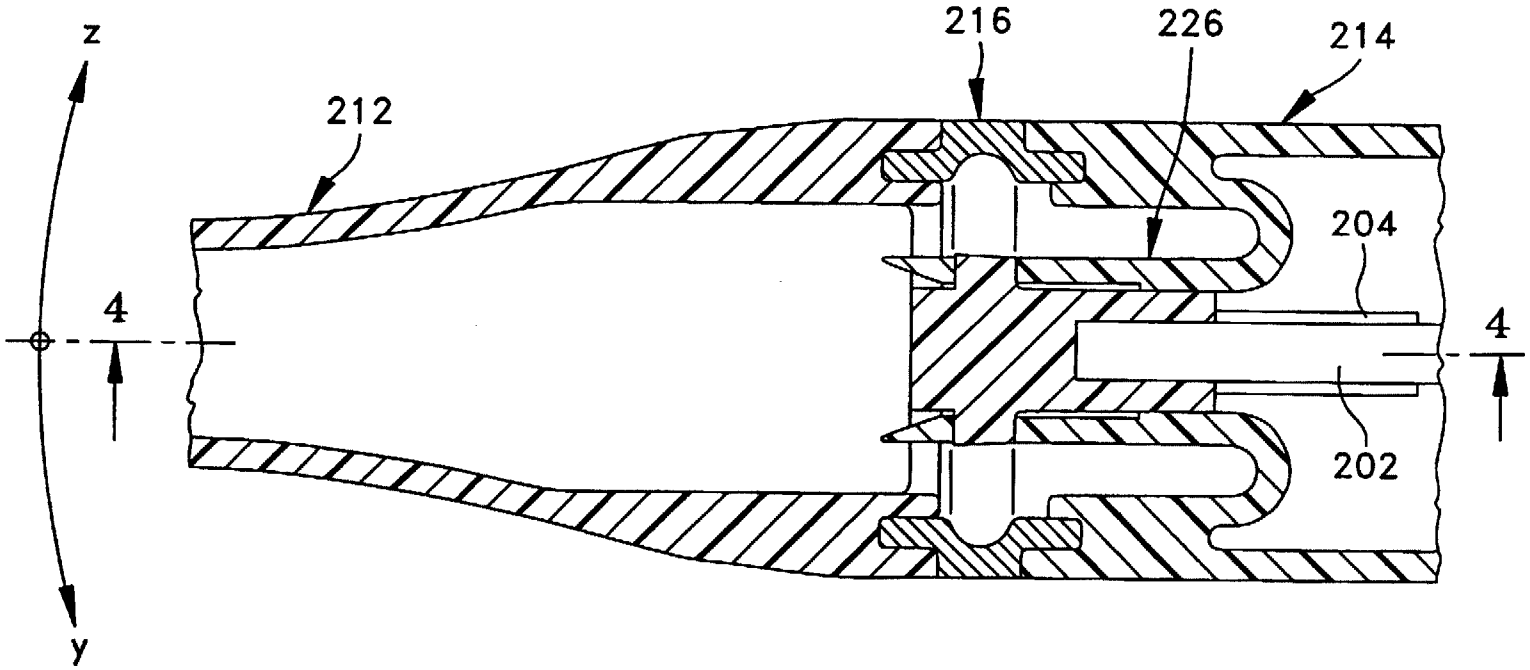
FIG. 5 shows a horizontal section according to the line V—V in FIG. 4.

FIG. 4 shows a second embodiment of a toothbrush 200, the reference symbols for the parts which correspond to parts of the first embodiment of the toothbrush having merely been prefixed by the number 2. This second embodiment differs from the first embodiment shown in FIG. 1 only by the fact that a leaf spring 202 for additional damping of the deflection movement in the direction of the arrow x of the brushneck 212 is inserted between a brushneck 212 and a handle 214. As shown in FIGS. 4 and 5, the leaf spring 202 is fastened in the front end, protruding into the cavity of the handle 214, of an articulated head 222 and has a curved end by which the leaf spring 202 bears upon a stop rib 204, which, as FIG. 5 shows, protrudes upwards from the inner side of the front wall 260 of the handle 214 in the centre and is somewhat wider in size than the leaf spring 202. The use of this additional leaf spring 202 can prove expedient depending upon the form and material used for an articulated fork 226 and upon the design and material of a sealing element 216.

Figure 6:
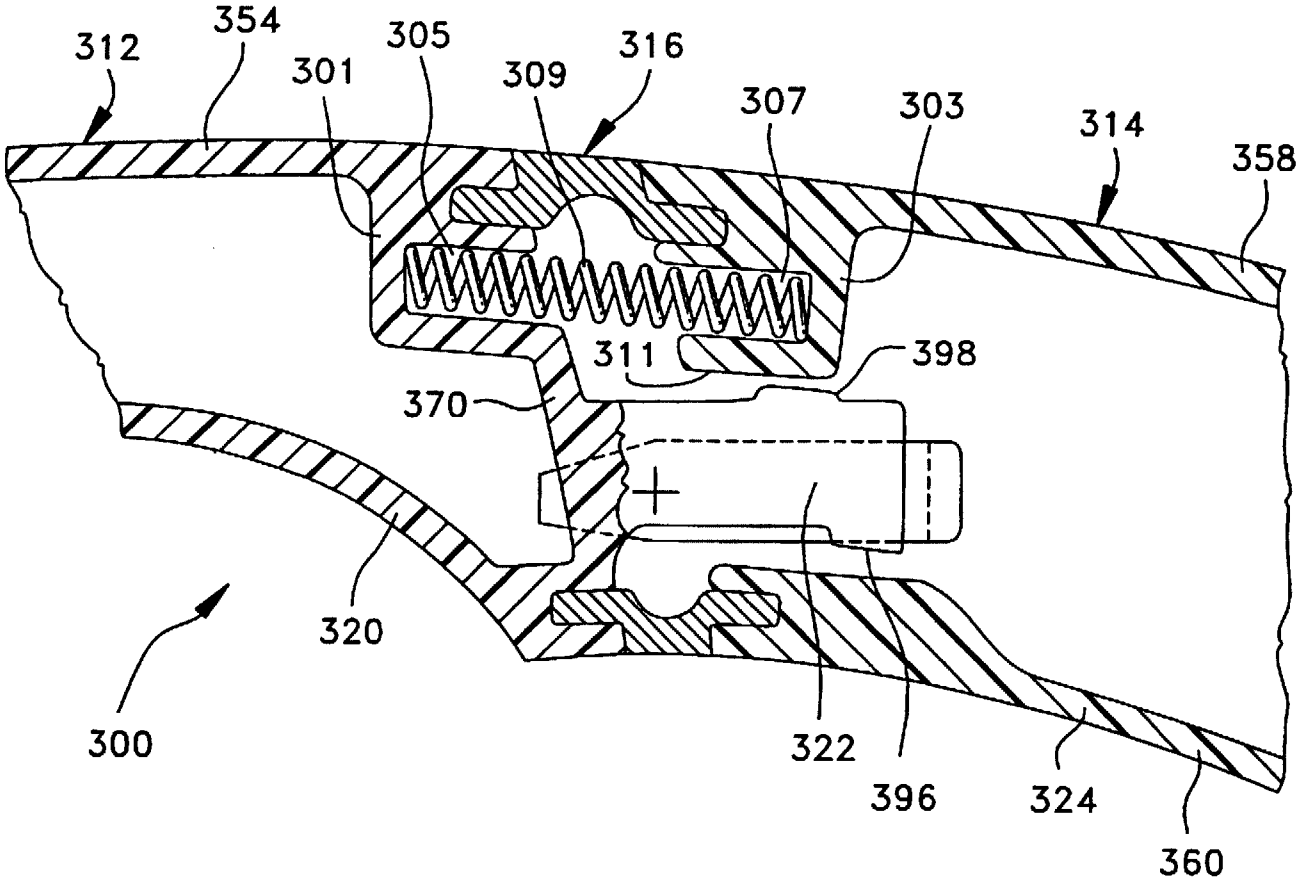
FIG. 6 shows a third embodiment of a toothbrush according to the invention in a perpendicular central longitudinal section similar to FIGS. 1 and 4.

FIG. 6 shows a third embodiment of a toothbrush 300 according to the invention, in which the reference symbols in FIG. 1 are prefixed by the number 3 for the same or corresponding parts. In the case of this toothbrush 300, coupling ends 320, 324 of a brushneck 312 and of a handle 314 are respectively provided with a supporting jaw 301, 303, which is in each case disposed on the inner side of a rear wall 354 of the brushneck 312 and of a rear wall 358 of the handle 314. In these supporting jaws 301, 303 there are provided coaxially opposite-lying indentations 305, 307 for receiving the ends of a helical compression spring 309, which ends extend approximately parallel to the rear walls 354, 358 through an annular sealing element 316. In this case, the supporting jaw 301 of the brushneck 312 is a component part of an end wall 370 of the brushneck 312. Here too, an articulated head 322 is an integral component part of the end wall 370 and exhibits a lesser height merely with regard to the supporting jaw 303 of the handle 314. In this instance, the articulated head 322 lies, as in the case of the first and second embodiments, with a stop cam 396 opposite the inner side of a front wall 360. On the other hand, the articulated head 322 is provided on its opposite side with a stop cam 398, which interacts with a stop surface 311 of the supporting jaw 303 of the handle 314, which stop surface faces the front wall 360 and runs approximately parallel to the longitudinal axis of the toothbrush 300.

By virtue of the fact that the helical compression spring 309, in the proximity of the outer and rear walls 354, 358 of the brushneck 312 and of the handle 314, runs approximately parallel thereto and is supported between coupling ends 320, 324 of the said brushneck and handle, any exaggerated deflection of the brushneck 312 resulting from an excessive contact pressure when cleaning the teeth is effectively damped.

Figure 8:
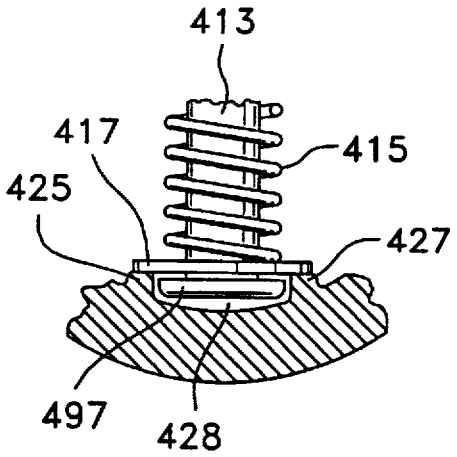
FIG. 8 shows a section according to the line VIII—VIII in FIG. 7.
Figure 7:
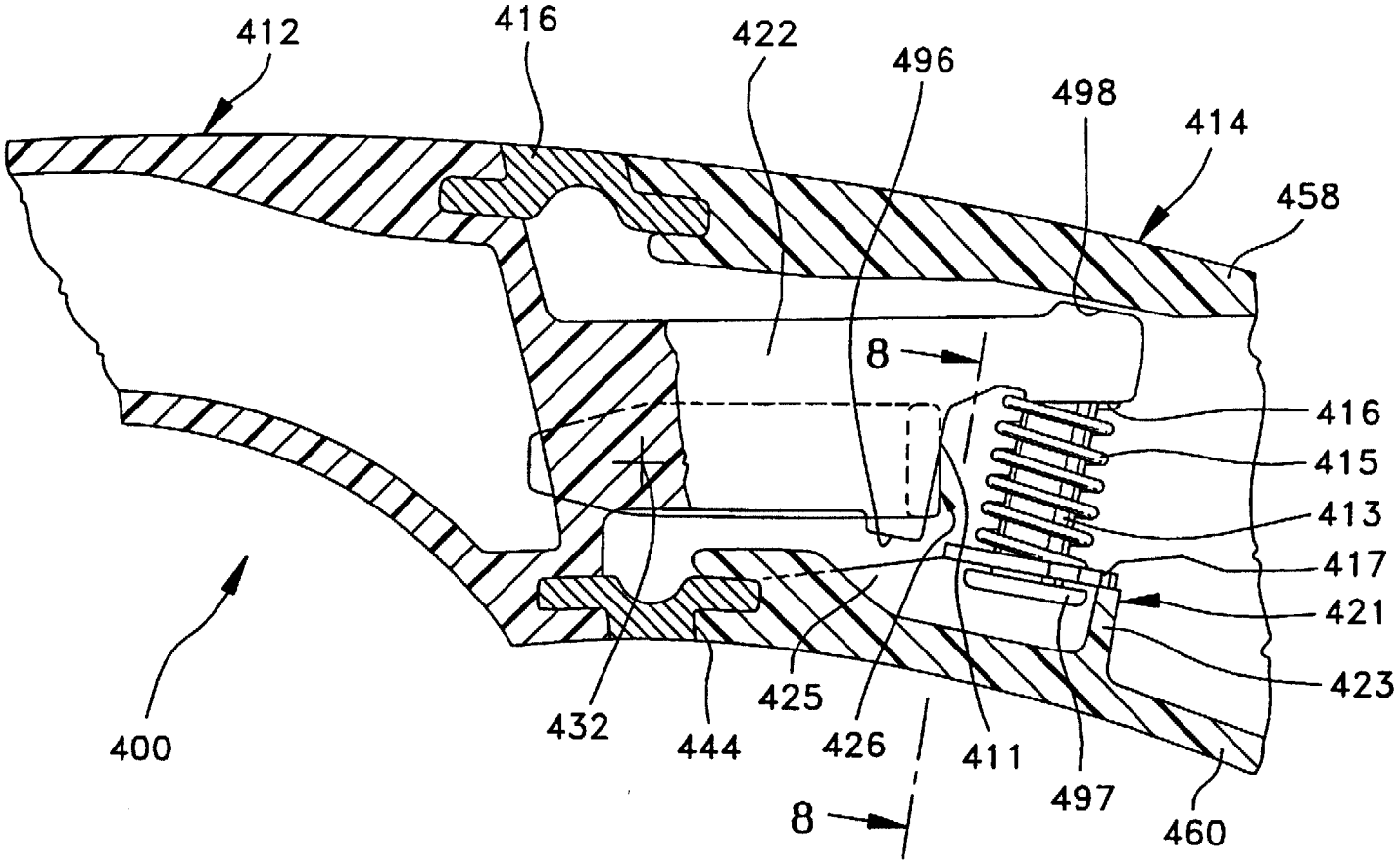
FIG. 7 shows a fourth embodiment of a toothbrush according to the invention in a perpendicular central longitudinal section similar to FIG. 6.

In FIGS. 7 and 8, a fourth embodiment of a toothbrush 400 of the invention is represented, in which figures the reference symbols in FIG. 1 are prefixed for identical or identically operating parts by the number 4. This toothbrush 400 differs from the above-described embodiments essentially by the fact that a stop cam 498 projects beyond an end face 411 of an articulated head 422 on the side facing the inner side of a rear wall 458 of a handle 414, yet otherwise, as in the case of the previously described embodiments, interacts as a stop surface with the inner side of the rear wall 458. The end face 411 of the articulated head 422 ends at its lower end in a stop cam 496. The stop cam 496 lies opposite an abutting surface 425 of a U-shaped supporting rib 421 on the inner side of a front wall 460. The abutting surface 425 forms a stop for the stop cam 496 of the articulated head 422 in order to limit the deflection movement of the brushneck when the teeth are cleaned.

The back of the stop cam 498, facing a front wall 460 of the handle 414, is provided with a guide shaft 413 for a compression spring 415, which is supported on the inner side of the front wall 460 of the handle 414. This support for the two ends of the compression spring 415 is provided by the back 416 of the stop cam 498 and by an annular supporting ring 417, which is mounted displaceably in the axial direction on a guide shaft 413 and is held by a dish-like widening 497 on the free end of the guide shaft 413. The supporting ring 417 exhibits a greated diameter in relation to the dish-like widening 497, so that is projects with its outer rim beyond the outer rim of the dish-like widening 497.

Onto the inner side of the front wall 460 of the handle 414 there is formed a supporting rib 421, which is U-shaped in top view. In FIG. 7, the crosspiece of this U-shaped supporting rib 421 is denoted by 423, from which crosspiece two legs 425, 427 (FIG. 8) extend up to the end face 444 of the handle 414. It can here be seen from FIG. 7 that the supporting rib 421 exhibits the greatest height in the area of its crosspiece 423, whereas the ends of the legs 425, 427 of the U-shaped supporting rib 421 end in the plane of the inner side of the front wall 460 of the handle 414. FIGS. 7 and 8 show that the supporting ring 417 bears with its outer rim, which radially overhangs the dish-like widening, upon the supporting rib 421, such that the dish-like widening 497 is surrounded at a distance by the supporting rib 421 and its legs 425, 427. At the same time, the dish-like widening 497, as shown in FIGS. 7 and 8, is disposed at a great enough axial distance from the inner side of the front wall 460 of the handle 414 to ensure that sufficient space is available to allow free axial mobility of the dish-like widening 497 upon deflection of the brushneck when cleaning the teeth, up to the point where the stop cam 496 of the articulated head 422 comes to bear upon the abutting surface 426 and terminates the deflection movement.

It can be seen that the U-shaped supporting rib 421, which is open in the direction of the brushneck 412, forms with its legs 425, 427, which gradually decrease in height in the direction of the ends, the oblique abutting surface 425 for the supporting ring 417 during the fitting of the toothbrush 400, a groove 428, formed by the supporting rib 421 and its legs 425, 427, forming a guide for the dish-like widening 497, until the said widening has adopted the position shown in FIG. 7 when the toothbrush 400 is fitted.

In the case of the described embodiment, a particularly fine tuning of the damping of the deflection movement of the brushneck 412 by the compression spring 415 in conjunction with a sealing element 416 between the brushneck 412 and the handle 414 is possible.

In the case of the second, third and fourth embodiments of the invention, the leaf spring and the represented helical springs consist of plastic or a corrosion-resistant metal. It can further be seen that, in all embodiments, the swivel joint is outwardly protected by the elastic sealing element and that the sealing element itself enables a hygienically satisfactory seal between the brushneck and the handle beyond the working life of the toothbrushes.

| Reference symbols list | |
|---|---|
| 10 | Toothbrush |
| 12 | Brushneck |
| 14 | Handle |
| 16 | Sealing element |
| 18 | Swivel joint |
| 20 | Coupling end |
| 22 | Articulated head |
| 24 | coupling end |
| 26 | Articulated fork |
| 28, 30 | Fork leg |
| 32 | Swivel axle |
| 34, 36 | Sealing sleeve |

-continued

| Reference symbols list | |
|---|---|
| 38, 40 | Recess |
| 42, 44 | End face |
| 46 | Sealing bead |
| 48, 50 | End face |
| 52 | Indentation |
| 54 | Rear wall |
| 56 | Front wall |
| 58 | Rear wall |
| 60 | Front wall |
| 62, 64 | Side wall |
| 66, 68 | Side wall |
| 70 | End wall |
| 72, 74 | Swivel journal |
| 76, 78 | Longitudinal side |
| 80, 82 | Leg base |
| 84, 86 | Opening |
| 88, 90 | Abutting surface |
| 92, 94 | Face ends |
| 96, 98 | Stop cam |
| 200 | Toothbrush |
| 202 | Leaf spring |
| 204 | Stop rib |
| 212 | Brushneck |
| 214 | Handle |
| 216 | Sealing element |
| 222 | Articulated head |
| 226 | Articulated fork |
| 260 | Front wall |
| 300 | Toothbrush |
| 301, 303 | Supporting jaw |
| 305, 307 | Indentation |
| 309 | Helical compression spring |
| 311 | Abutting surface |
| 312 | Brushneck |
| 314 | Handle |
| 316 | Sealing element |
| 320 | Coupling end |
| 322 | Articulated head |
| 324 | Coupling end |
| 354, 358 | Rear wall |
| 370 | End wall |
| 396, 398 | Stop cam |
| 400 | Toothbrush |
| 412 | Brushneck |
| 413 | Guide shaft |
| 414 | Handle |
| 415 | Helical compression spring |
| 416 | Back (stop cam) |
| 417 | Supporting ring |
| 421 | Supporting rib |
| 422 | Articulated head |
| 423 | Crosspiece, supporting rib |
| 426 | Articulated fork |
| 425, 427 | Rib leg with abutting surface |
| 428 | Groove |
| 432 | Swivel axle |
| 444 | End face, handle |
| 458 | Rear wall |
| 460 | Front wall |
| 497 | Dish-like widening |
| 496, 498 | Stop cam |

We claim:

1. A toothbrush comprising a brushneck connected to an exchangeable brushhead, the brushneck being deflectably held, in a resilient manner, on a hollow handle by a swivel joint surrounded by a sealing element and by a tension spring extending in the hollow handle, the swivel joint having a swivel axle, the brushneck being provided at its coupling end facing the handle with an articulated head and the handle exhibiting at its coupling end facing the brushneck an articulated fork, the articulated head of the brushneck being fitted-in between fork legs of the articulated fork and connected to the articulated fork by the swivel axle, wherein the sealing element consists of a pressure-elastic material and the articulated fork forms the tension spring, and wherein the sealing element is held by the articulated fork under elastic pre-tension between the coupling ends of the handle and of the brushneck.

2. A toothbrush according to claim 1, wherein the sealing element is annular and is provided at both ends with sealing sleeves, and wherein the coupling ends of the handle and of the brushneck exhibit recesses into which the sealing sleeves hermetically engage.

3. A toothbrush according to claim 2, wherein the recesses comprise annular grooves which are disposed in end faces of the coupling ends of the handle and of the brushneck.

4. A toothbrush according to claim 3, wherein the sealing element has an annular sealing bead positioned between the sealing sleeves, the annular sealing bead having a cross-sectional profile which coincides with a cross-sectional profile of the coupling ends of the handle and of the brushneck, the annular sealing bead bearing with its two end faces tightly against end faces of the handle and of the brushneck.

5. A toothbrush according to claim 4, wherein the sealing bead has an inner peripheral surface which exhibits a circumferential indentation.

6. A toothbrush according to claim 1, wherein the swivel axle of the swivel joint is disposed in a principal plane of the sealing element close to a front wall.

7. A toothbrush according to claim 6, wherein the principal plane of the sealing element extends rearwards from the front wall of the toothbrush, obliquely to a central longitudinal axis of the toothbrush, to a rear wall.

8. A toothbrush according to claim 1, wherein the articulated head protrudes axially from the coupling end of the brushneck into the handle, the swivel axle comprising two swivel journals which extend perpendicularly and coaxially from two longitudinal sides of the articulated head.

9. A toothbrush according to claim 8, wherein the fork legs of the articulated fork are fastened tension-elastically to opposite side walls of the handle and are directed with their free ends towards the coupling end of the brushneck, the fork legs having leg ends with coaxial, continuous openings for the engagement of the swivel journals.

10. A toothbrush according to claim 8, wherein the fork legs are pre-tensioned against each other, such that the fork legs bear with pre-tension against the longitudinal sides of the articulated head.

11. A toothbrush according to claim 10, wherein the ends of the fork legs are provided with mutually opposite, beveled abutting surfaces, the greatest clear distance between which is greater in size than the distance between correspondingly beveled face ends of the two swivel journals.

12. A toothbrush according to claim 8, wherein each swivel journal has a length corresponding approximately to a thickness of the fork legs of the articulated fork.

13. A toothbrush according to claim 1, wherein an end of the articulated head which projects into a cavity of the handle is provided with two stop cams for limiting deflection of the brushneck.

14. A toothbrush according to claim 1, wherein a second spring for damping deflection of the brushneck is inserted between the handle and the brushneck.

15. A toothbrush according to claim 14, wherein the second spring is a leaf spring, one end of said leaf spring being fastened to a free end of the articulated head protruding into the handle and a second end of said leaf spring being supported on a supporting rib of a front wall of the handle.

16. A toothbrush according to claim 1, further comprising a supporting jaw disposed on an inner side of a rear wall of the brushneck and of the handle, said supporting jaw having coaxially opposite-lying indentations for receiving ends of a compression spring which extends through the sealing element.

17. A toothbrush according to claim 16, wherein the supporting jaw includes an abutting surface for contacting a stop cam.

18. A toothbrush according to claim 1, further comprising a stop cam with a guide shaft for a helical compression spring, the guide shaft having an end configured as a dish-like widening.

19. A toothbrush according to claim 18, further comprising a supporting ring displaceably mounted on the guide shaft and held by the dish-like widening, the helical compression spring being supported by the stop cam and the supporting ring.

20. A toothbrush according to claim 19, wherein the supporting ring exhibits an outer rim which radially overhangs the dish-like widening, further comprising a supporting rib surrounding the dish-like widening at a radial distance.

21. A toothbrush according to claim 20, wherein the supporting rib is U-shaped in top view, the supporting ring bearing upon a crosspiece and upon adjoining parts of legs of the supporting rib.

22. A toothbrush according to claim 21, wherein the legs of the supporting rib form an abutting surface for limiting deflection movement of the brushneck.

* * * * *